US006071100A

United States Patent [19]

Yamada et al.

[11] Patent Number: 6,071,100

[45] Date of Patent: Jun. 6, 2000

[54] SCROLL COMPRESSOR HAVING LUBRICATION OF THE ROTATION PREVENTING MEMBER

[75] Inventors: Sadayuki Yamada, Ootsu; Takashi Morimoto, Nagaokakyo; Hideo Hirano; Hiroyuki Kawano, both of Kusatsu; Hideto Oka, Shiga-ken; Shigeru Muramatsu, Kusatsu, all of Japan

[73] Assignee: Matsushita Electric Industrial Co., Ltd., Osaka, Japan

[21] Appl. No.: 08/870,237

[22] Filed: Jun. 5, 1997

[51] Int. Cl.[7] ..... F04C 18/04; F04C 29/02

[52] U.S. Cl. ..... 418/55.3; 418/55.4; 418/55.6; 418/88; 418/99

[58] Field of Search ..... 418/55.3, 55.4, 418/55.6, 88, 94, 99

[56] References Cited

U.S. PATENT DOCUMENTS

| | | | |
|---|---|---|---|
| 5,217,359 | 6/1993 | Kawahara et al. | 418/55.6 |
| 5,645,408 | 7/1997 | Fujio et al. | 418/55.4 |
| 5,695,326 | 12/1997 | Oka et al. | 418/55.1 |
| 5,746,586 | 5/1998 | Fukuhara et al. | 418/55.2 |

FOREIGN PATENT DOCUMENTS

| | | | |
|---|---|---|---|
| 58-70081 | 4/1983 | Japan | 418/55.3 |
| 2277986 | 11/1990 | Japan | 418/55.3 |

*Primary Examiner*—John J. Vrabllik
*Attorney, Agent, or Firm*—McDermott, Will & Emery

[57] ABSTRACT

A scroll compressor includes a fixed scroll and an orbiting scroll which define therebetween a plurality of compression chambers for compressing fluid introduced via a suction port. The orbiting scroll has a base plate and a shaft portion extending from the base plate toward a crankshaft rotatably supported by a support member. A seal member is disposed between the base plate and the support member to define an inner region and an outer region. The inner region surrounds the shaft portion, while the outer region includes therein a rotation preventing member interposed between the base plate of the orbiting scroll and the support member. The inner region communicates with the outer region via an oil-feed passage formed through the orbiting scroll. The oil-feed passage includes therein a restrictor and opens in the neighborhood of an upper sliding portion between the rotation preventing member and the support member. Thus, lubricating oil supplied to the inner region is fed to the neighborhood of the upper sliding portion via the oil-feed passage for lubrication thereof. The lubricating oil collects downward due to the gravity to achieve lubrication of a lower sliding portion between the rotation preventing member and the support member.

20 Claims, 7 Drawing Sheets

SCROLL COMPRESSOR HAVING LUBRICATION OF THE ROTATION PREVENTING MEMBER

BACKGROUND OF THE INVENTION

1. Field of the Invention

The present invention relates to a scroll compressor for compressing fluid, such as air or refrigerant gas.

2. Description of the Prior Art

FIG. 9 shows the whole structure of a conventional scroll compressor. In the figure, numeral 101 denotes an electric motor for driving a crankshaft 102. The crankshaft 102 is rotatably supported by a support member 107 via a bearing at its one end wherein the crankshaft 102 is provided with an eccentric engaging portion 103. The eccentric engaging portion 103 receives therein a shaft portion 105 of an orbiting scroll 104 via an eccentric bearing. The orbiting scroll 104 is prevented from rotation on its axis by an Oldham's ring 106, as a rotation preventing member, interposed between the orbiting scroll 104 and the support member 107, while it makes a swing motion or an orbital motion depending on the rotation of the crankshaft 102 via the shaft portion 105 thereof.

The orbital motion of the orbiting scroll 104 causes compression chambers 108 formed between a spiral vane of the orbital scroll 104 and a spiral vane of a fixed scroll 113 to move toward the center of the spiral vanes and reduce their volumes to thereby compress fluid introduced via a suction port. The compressed fluid is then discharged from the center of the fixed scroll 113.

A seal member 114 is disposed between the orbiting scroll 104 and the support member 107 to define an inner region surrounding the shaft portion 105 of the orbiting scroll 104 and an outer region communicating with the foregoing suction port.

Lubricating oil is drawn up from a lubricating oil storage 110 by a trochoid pump 109 and passes through a through hole 111 of the crankshaft 102 to reach the foregoing inner region. In the inner region, a portion of the lubricating oil is fed to the eccentric bearing disposed between the shaft portion 105 of the orbiting scroll 104 and the eccentric engaging portion 103 of the crankshaft 102 and then to the bearing disposed between the eccentric engaging portion 103 and the support member 107 and then returned to the lubricating oil storage 110. The other portion of the lubricating oil passes through an oil-feed passage formed in the orbiting scroll 104 to reach a lower part of the foregoing outer region. The oil-feed passage includes therein a restrictor 112. In the outer region, the lubricating oil is fed to the Oldham's ring 106 and a sliding portion between the orbiting and fixed scrolls 104 and 113 for lubrication thereof.

However, since the foregoing oil-feed passage extends downward and opens to the lower part of the outer region, it is difficult for the lubricating oil to go up to an upper portion of the Oldham's ring 106 due to the gravity. This causes a large frictional loss at an upper sliding portion between the Oldham's ring 106 and the support member 107, thus lowering the compressor efficiency and further inducing an occurrence of seizure. The Oldham's ring 106 and the support member 107 are made of the same material.

In addition, the lubricity at the sliding portion is largely lowered when using an HFC refrigerant and an ester oil as lubricating oil, as compared with the lubricity when using an HCFC refrigerant and a mineral oil as lubricating oil. Thus, an occurrence of seizure is more liable in recent air conditioners and the like.

FIG. 10 is a perspective view of the Oldham's ring 106. The lubrication of the sliding portions between the Oldham's ring 106 and the support member 107 is performed by using the lubricating oil in the neighborhood of the sliding portions. However, with key portions 115 having the shown shape, the Oldham's ring 106 does not work well for effectively introducing the lubricating oil to the sliding portions.

SUMMARY OF THE INVENTION

Therefore, it is an object of the present invention to provide an improved scroll compressor that can eliminate one or more of the foregoing disadvantages.

According to one aspect of the present invention, a scroll compressor comprises a sealed casing; a fixed scroll provided in the sealed casing, the fixed scroll having a first spiral vane; an orbiting scroll provided in the sealed casing, the orbiting scroll having a base plate provided with a second spiral vane which is mated with the first spiral vane to define therebetween a plurality of compression chambers, the orbiting scroll further having a shaft portion extending from the base plate toward a crankshaft which is rotatably supported by a support member fixed in the sealed casing; a rotation preventing member provided between the base plate and the support member for preventing rotation of the orbiting scroll on its axis; an electric motor for driving the crankshaft to cause an orbital motion of the orbiting scroll via the shaft portion, the orbital motion reducing volumes of the compression chambers for compressing fluid introduced via a suction port; and a seal member disposed between the base plate and the support member for defining an inner region and an outer region, the shaft portion of the orbiting scroll exposed to the inner region, while the outer region communicating with the suction port and including therein the rotation preventing member, wherein the inner region communicates with the outer region via an oil-feed passage formed through the orbiting scroll, and wherein the oil-feed passage includes therein a restrictor and opens in the neighborhood of an upper sliding portion between the rotation preventing member and the support member in the outer region so that lubricating oil supplied to the inner region is fed to the neighborhood of the upper sliding portion via the oil-feed passage for lubrication of the upper sliding portion.

It may be arranged that the lubricating oil fed to the neighborhood of the upper sliding portion collects downward due to the gravity to achieve lubrication of a lower sliding portion between the rotation preventing member and the support member.

It may be arranged that the shaft portion is formed with an axial hole open to the inner region and extending in an axial direction of the crankshaft, and the base plate is formed with a radial hole including the restrictor, the radial hole being continuous with the axial hole and extending radially upward relative to the crankshaft so as to open in the neighborhood of the upper sliding portion, the axial and radial holes forming the oil-feed passage.

It may be arranged that the oil-feed passage is open at a front side of the upper sliding portion relative to an orbiting direction of the orbiting scroll.

It may be arranged that the rotation preventing member is an Oldham's ring provided with a key portion having a tapered end in a radially outward direction with respect to the Oldham's ring, the key portion engaging with the support member at the upper sliding portion.

It may be arranged that the rotation preventing member is an Oldham's ring provided with a key portion having a groove which extends slantly inward from a radially outward end of the key portion, the key portion engaging with the support member at the upper sliding portion.

It may be arranged that the rotation preventing member is an Oldham's ring provided with a key portion having a bent through hole which extends inward from a radially outward end of the key portion, the key portion engaging with the support member at the upper sliding portion.

It may be arranged that the rotation preventing member is an Oldham's ring provided with a key portion having a cavity at the sliding portion for storing the lubricating oil therein, the key portion engaging with the support member at the upper sliding portion.

It may be arranged that an HFC refrigerant is used as the fluid and an ester oil is used as the lubricating oil.

According to another aspect of the present invention, a scroll compressor comprises a sealed casing; a fixed scroll provided in the sealed casing, the fixed scroll having a first spiral vane; an orbiting scroll provided in the sealed casing, the orbiting scroll having a base plate provided with a second spiral vane which is mated with the first spiral vane to define therebetween a plurality of compression chambers, the orbiting scroll further having a shaft portion extending from the base plate toward a crankshaft which is rotatably supported by a support member fixed in the sealed casing; an Oldham's ring provided between the base plate and the support member for preventing rotation of the orbiting scroll on its axis; an electric motor for driving the crankshaft to cause an orbital motion of the orbiting scroll via the shaft portion, the orbital motion reducing volumes of the compression chambers for compressing fluid introduced via a suction port; and a seal member disposed between the base plate and the support member for defining an inner region and an outer region, the shaft portion of the orbiting scroll exposed to the inner region, while the outer region communicating with the suction port and including therein the Oldham's ring, wherein the inner region communicates with the outer region via an oil-feed passage formed through the orbiting scroll so that lubricating oil supplied to the inner region is fed to the outer region, and wherein the Oldham's ring has key portions each having means for effectively feeding the lubricating oil in the outer region to corresponding one of sliding portions between the key portions and the support member.

It may be arranged that the means comprises a tapered end of the key portion provided in a radially outward direction with respect to the Oldham's ring.

It may be arranged that the means comprises a groove of the key portion which extends slantly inward from a radially outward end of the key portion toward the sliding portion.

It may be arranged that the means comprises a bent through hole which extends inward from a radially outward end of the key portion toward the sliding portion.

It may be arranged that the means comprises a cavity of the key portion provided at the sliding portion for storing the lubricating oil therein.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, a first preferred embodiment of the present invention will be described hereinbelow with reference to FIGS. 1 and 2.

Figure 1:
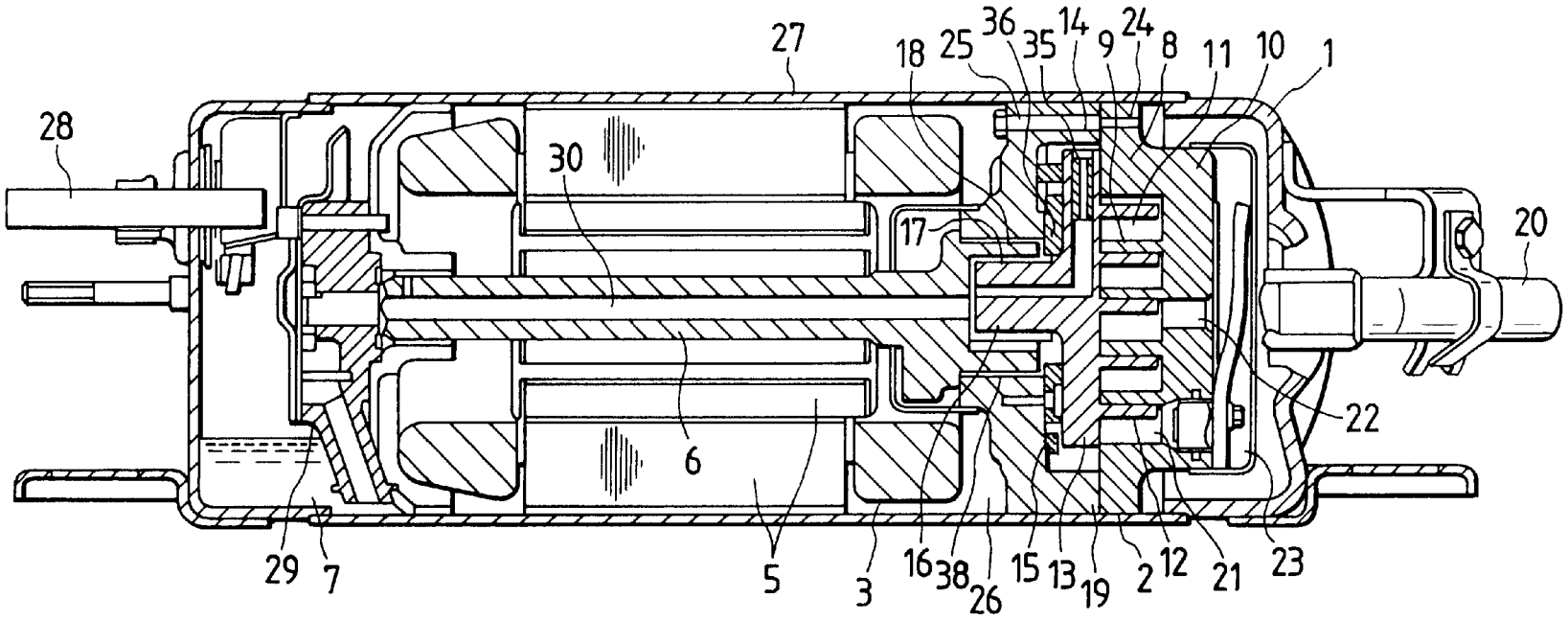
FIG. 1 is a longitudinal sectional view of a scroll compressor according to a first preferred embodiment of the present invention.
Figure 2:
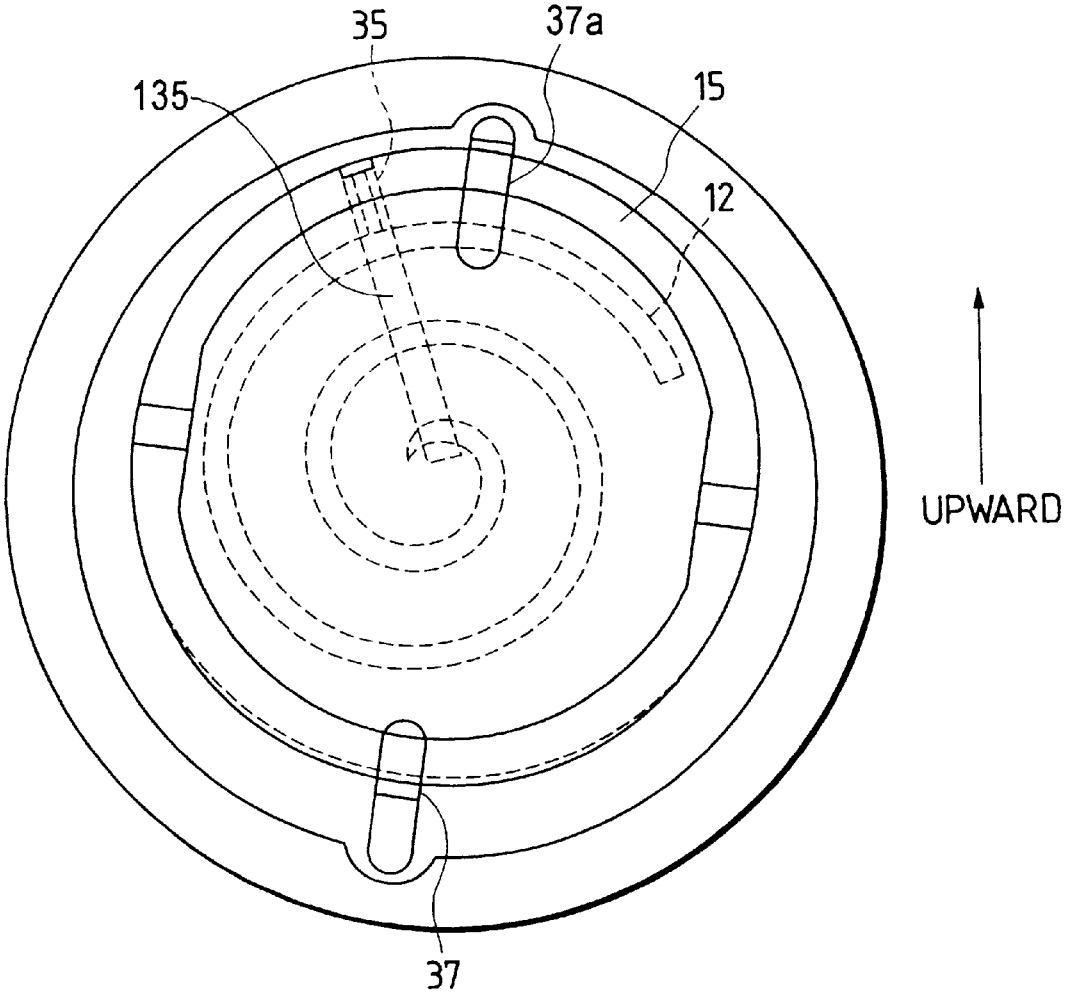
FIG. 2 is an enlarged view of the main part of the scroll compressor shown in FIG. 1.

FIG. 1 is a longitudinal sectional view of a scroll compressor according to the first preferred embodiment, and FIG. 2 is an enlarged view of the main part thereof.

Referring to FIG. 1, the scroll compressor includes, in a sealed casing 1, a compression unit 2 and an electric motor 3. Numeral 5 denotes a stator of the electric motor 3. A crankshaft 6 is coupled to a rotor of the electric motor 3 for transmitting a rotation force of the electric motor 3 to the compression unit 2. The crankshaft 6 is rotatably supported by a support member 19 via a bearing 38 at its one end wherein the crankshaft 6 is provided with an eccentric engaging portion 17. The support member 19 is fixed to the sealed casing 1. The compression unit 2 includes a fixed scroll 10 having a base plate 8 and a spiral vane 9 provided on one side of the base plate 8. The compression unit 2 further includes an orbiting scroll 14 having a base plate 13 and a spiral vane 12 provided on one side of the base plate 13. The base plate 13 is further provided with a shaft portion 16 on a side thereof opposite to the side where the spiral vane 12 is provided. The shaft portion 16 is received in the eccentric engaging portion 17 of the crankshaft 6 via an eccentric bearing 18. The spiral vanes 9 and 12 of the scrolls 10 and 14 are interfitted or mated with each other to define therebetween a plurality of compression chambers 11.

When the electric motor 3 is driven, the rotation force is generated and transmitted to the compression unit 2 via the crankshaft 6. Specifically, the rotation force is transmitted to the shaft portion 16 of the orbiting scroll 14 via the eccentric bearing 18. Since the orbiting scroll 14 is prevented from rotation on its axis by an Oldham's ring 15, as a rotation preventing member, disposed between the base plate 13 of the orbiting scroll 14 and the support member 19, it makes a swing motion or an orbital motion depending on the rotation of the crankshaft 6. The orbital motion of the orbiting scroll 14 causes the compression chambers 11 to move toward the center of the spiral vanes and reduce their volumes. Thus, low-pressure refrigerant gas introduced via an inlet pipe 20 and a suction port 21 of the compression unit 2 is successively compressed in the compression chambers 11. Subsequently, the compressed high-pressure refrigerant gas is discharged to a discharge chamber 23 via a discharge port 22 of the compression unit 2, then discharged to a discharge chamber 26 between the compression unit 2 and the electric motor 3 via a discharge passage 24 formed at a peripheral portion of the base plate 8 of the fixed scroll 10 and a discharge passage 25 formed at a peripheral portion of the support member 19, and further discharged to the exterior of the sealed casing 1 via an outlet pipe 28 after passing through a peripheral passage 27 formed around the electric motor 3.

In this preferred embodiment, as shown in FIG. 2, sliding portions 37 between the Oldham's ring 15 and the support member 19 are arranged at positions in upward and downward directions.

On the other hand, lubricating oil drawn up from an lubricating oil storage 7 by a trochoid pump 29 provided at the other end of the crankshaft 6 passes through a through hole 30 of the crankshaft 6 toward the shaft portion 16 of the orbiting scroll 14. Then, a portion of the lubricating oil is fed to an inner region defined by a seal member 36 disposed between the support member 19 and the base plate 13 of the orbiting scroll 14. The inner region surrounds the shaft portion 16 of the orbiting scroll 14. In the inner region, the lubricating oil is fed to the eccentric bearing 18 and the bearing 38 for lubrication thereof, and then returned to the lubricating oil storage 7. The other portion of the lubricating oil is fed to an outer region defined by the seal member 36 via an oil-feed passage 135 formed in the shaft portion 16 and the base plate 13 of the orbiting scroll 14. Specifically, the oil-feed passage 135 has an axial hole formed in the shaft portion 16 and a radial hole formed in the base plate 13 of the orbiting scroll 14 and including therein a restrictor 35. The axial hole is open to the foregoing inner region and extends in the axial direction of the crankshaft 6, while the radial hole is continuous with the axial hole and extends radially upward relative to the crankshaft 6 so as to open in the neighborhood of the upper sliding portion 37 between the Oldham's ring 15 and the support member 19 in the foregoing outer region as seen from FIG. 2. The lubricating oil flowing to the neighborhood of the upper sliding portion 37 achieves lubrication of the upper sliding portion 37 and collects downward due to the gravity so as to achieve lubrication of the lower sliding portion 37. The lubricating oil is also introduced into the compression chambers 11 via the suction port 21 for sealing purpose.

In this preferred embodiment, the orbiting scroll 14 is made of aluminum, while the Oldham's ring 15 and the support member 19 are made of iron.

As appreciated, according to the foregoing first preferred embodiment, since the oil-feed passage including the restrictor 35 and formed in the orbiting scroll 14 is open in the neighborhood of the upper sliding portion 37 between the Oldham's ring 15, as the rotation preventing member, and the support member 19, the lubricating oil passing through the oil-feed passage is liable to flow to the upper sliding portion 37 so as to achieve lubrication thereof.

Although the HFC refrigerant and the ester lubricating oil are used in the foregoing first preferred embodiment, since the lubricating oil can be sufficiently supplied to the sliding portions 37, the lowering of the compressor efficiency as well as the occurrence of seizure can be effectively prevented.

Now, a second preferred embodiment of the present invention will be described hereinbelow with reference to FIG. 3.

Figure 3:
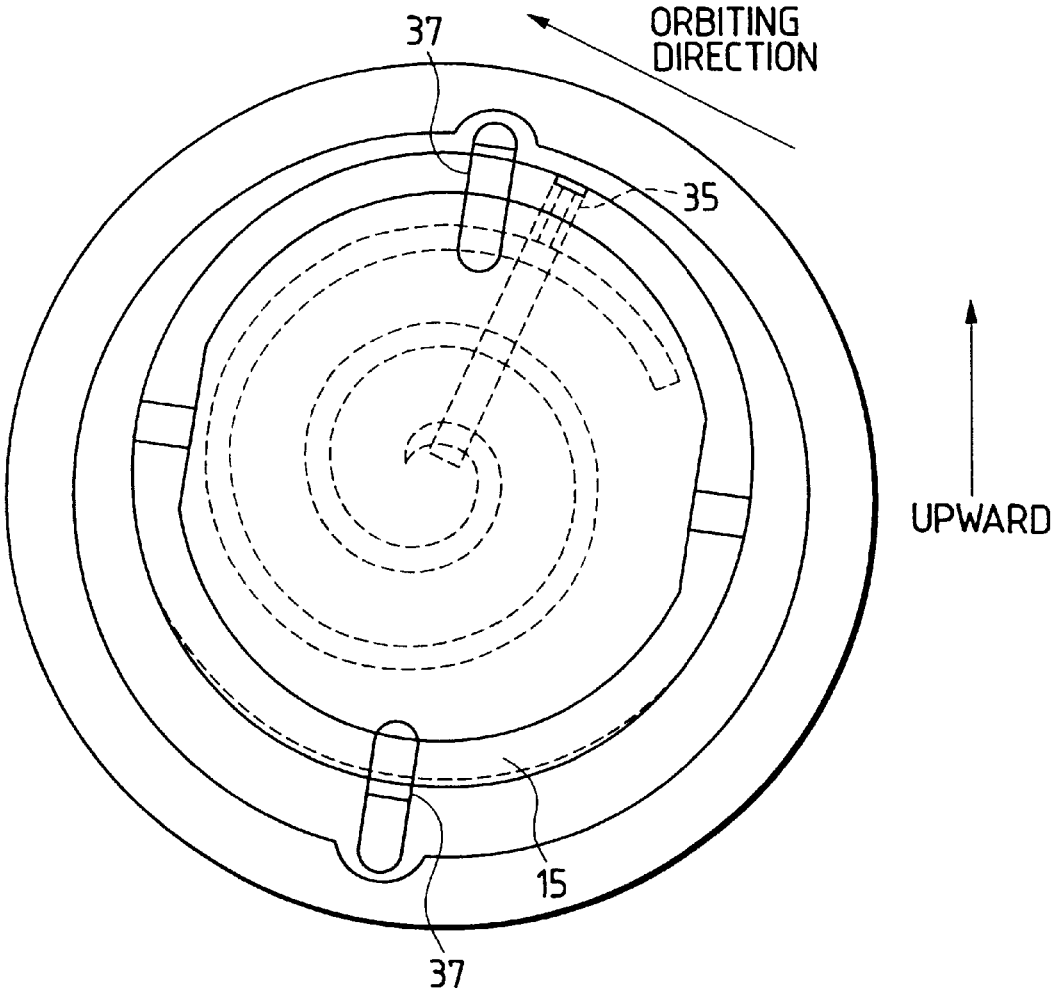
FIG. 3 is an enlarged view of the main part of a scroll compressor according to a second preferred embodiment of the present invention.

FIG. 3 is an enlarged view of the main part of a scroll compressor according to the second preferred embodiment.

The second preferred embodiment differs from the first preferred embodiment only in that the oil-feed passage including the restrictor 35 formed in the orbiting scroll 14 is open at a front side of the upper sliding portion 37 relative to an orbiting direction of the orbiting scroll 14.

With this arrangement, the lubricating oil can be supplied more to the side of the upper sliding portion 37 where a reaction force of the Oldham's ring 15 during compression is exerted.

The other structure is the same as that of the first preferred embodiment.

Now, a third preferred embodiment of the present invention will be described hereinbelow with reference to FIGS. 4 and 5.

Figure 4:
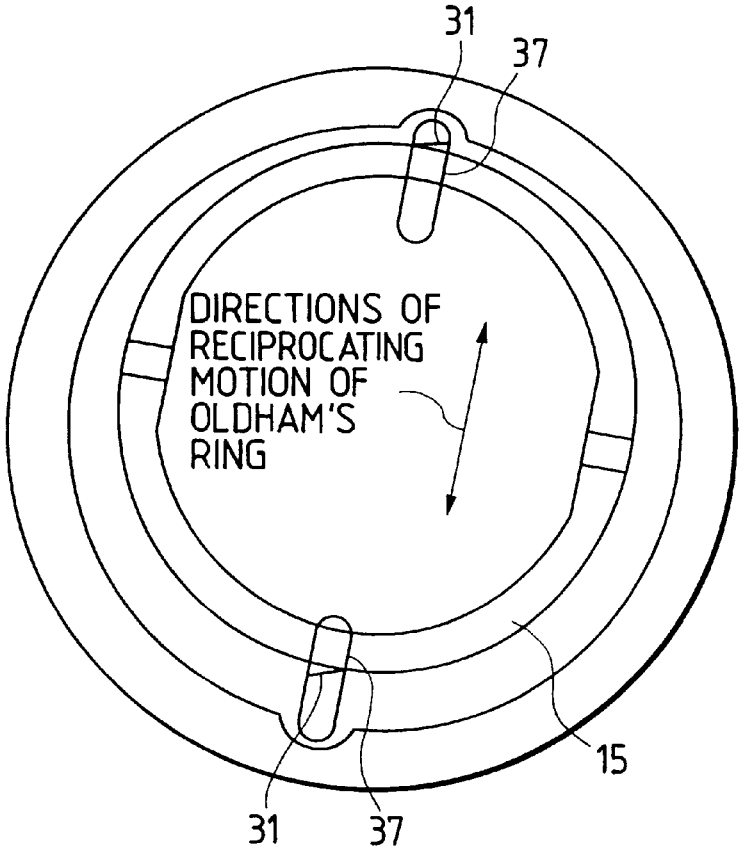
FIG. 4 is an enlarged view of the main part of a scroll compressor according to a third preferred embodiment of the present invention.
Figure 5:
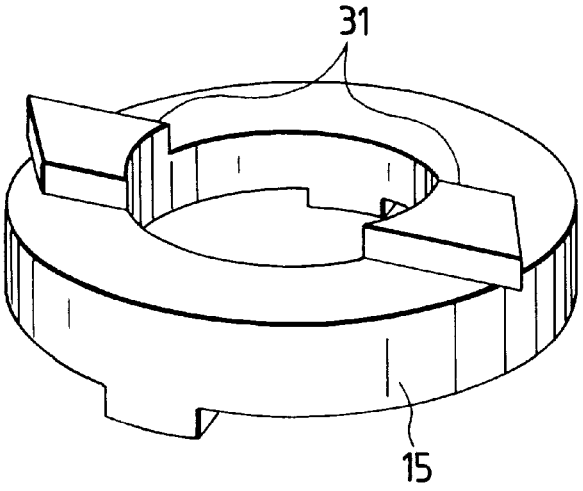
FIG. 5 is a perspective view of an Oldham's ring, as a rotation preventing member, according to the third preferred embodiment.

FIG. 4 is an enlarged view of the main part of a scroll compressor according to the third preferred embodiment, and FIG. 5 is a perspective view of an Oldham's ring 15 according to the third preferred embodiment.

The third preferred embodiment differs from the first or second preferred embodiment only in that the Oldham's ring 15 has a pair of key portions 31 each having a tapered end in a radially outward direction with respect to the Oldham's ring 15.

With this arrangement, the lubricating oil in the neighborhood of each key portion 31 can be mechanically supplied to the sliding portion 37 by utilizing the reciprocating motion of the Oldham's ring 15 itself. Thus, the lubricating oil can be fed to the sliding portion 37 more effectively.

The other structure is the same as that of the first or second preferred embodiment.

Now, a fourth preferred embodiment of the present invention will be described hereinbelow with reference to FIG. 6.

Figure 6:
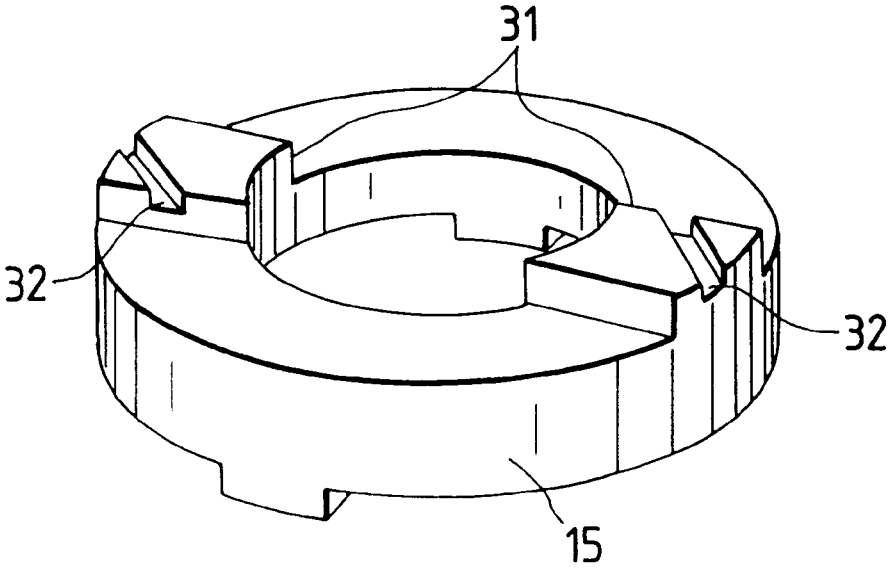
FIG. 6 is a perspective view of an Oldham's ring, as a rotation preventing member, according to a fourth preferred embodiment of the present invention.

FIG. 6 is a perspective view of an Oldham's ring 15 according to the fourth preferred embodiment.

The fourth preferred embodiment differs from the first or second preferred embodiment only in that the Oldham's ring 15 has a pair of key portions 31 each having a groove 32 which extends slantly inward from a radially outward end of the key portion 31 toward the sliding portion 37.

With this arrangement, the lubricating oil in the neighborhood of each key portion 31 can be mechanically supplied to the sliding portion 37 by utilizing the reciprocating motion of the Oldham's ring 15 itself. Thus, the lubricating oil can be fed to the sliding portions 37 more effectively.

The other structure is the same as that of the first or second preferred embodiment.

Now, a fifth preferred embodiment of the present invention will be described hereinbelow with reference to FIG. 7.

Figure 7:
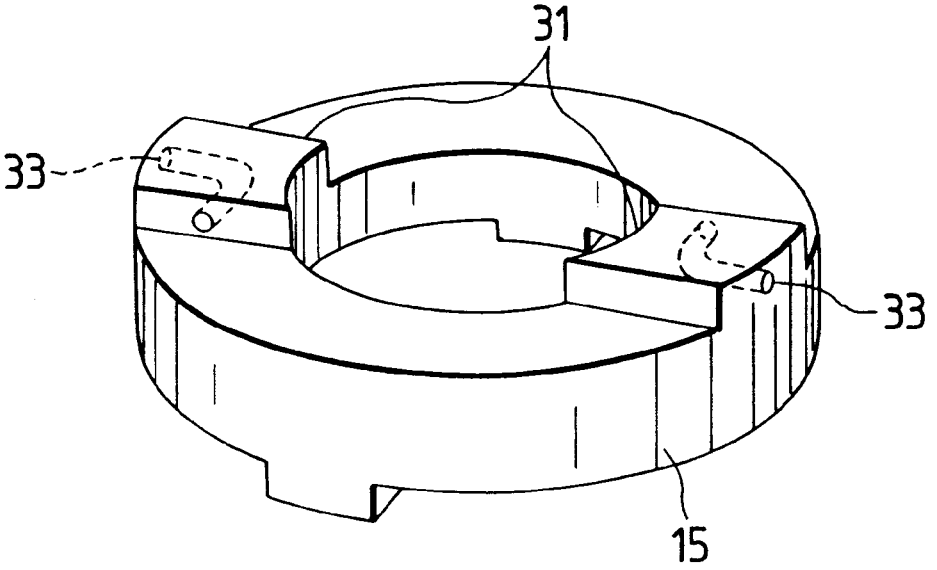
FIG. 7 is a perspective view of an Oldham's ring, as a rotation preventing member, according to a fifth preferred embodiment of the present invention.

FIG. 7 is a perspective view of an Oldham's ring 15 according to the fifth preferred embodiment.

The fifth preferred embodiment differs from the first or second preferred embodiment only in that the Oldham's ring 15 has a pair of key portions 31 each having a bent through hole 33 which extends inward from a radially outward end of the key portion 31 toward the sliding portion 37.

With this arrangement, the lubricating oil in the neighborhood of each key portion 31 can be mechanically supplied to the sliding portion 37 by utilizing the reciprocating motion of the Oldham's ring 15 itself. Thus, the lubricating oil can be fed to the sliding portions 37 more effectively.

The other structure is the same as that of the first or second preferred embodiment.

Now, a sixth preferred embodiment of the present invention will be described hereinbelow with reference to FIG. 8.

Figure 8:
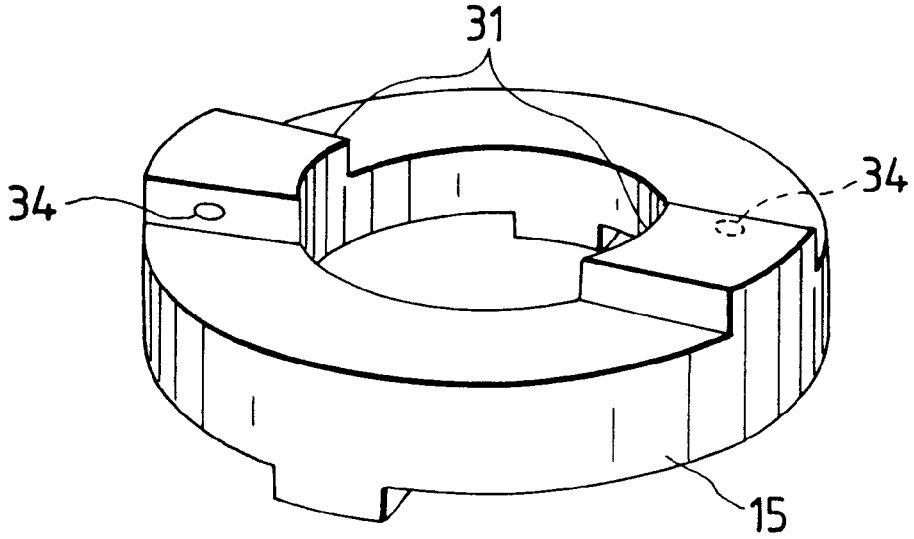
FIG. 8 is a perspective view of an Oldham's ring, as a rotation preventing member, according to a sixth preferred embodiment of the present invention.
Figure 10:
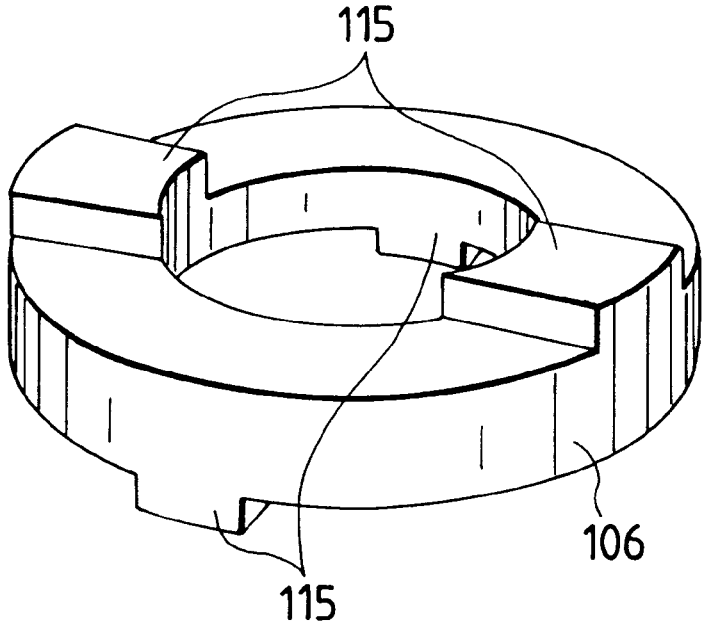
FIG. 10 PRIOR ART
FIG. 10 is a perspective view of an Oldham's ring incorporated in the conventional scroll compressor shown in FIG. 9.

FIG. 8 is a perspective view of an Oldham's ring 15 according to the sixth preferred embodiment.

The sixth preferred embodiment differs from the first or second preferred embodiment only in that the Oldham's ring 15 has a pair of key portions 31 each having a cavity 34 at the sliding portion 37 for storing the lubricating oil therein.

With this arrangement, since the lubricating oil can be stored in each cavity 34 at the sliding portion 37, the lubricating oil can be fed to the sliding portions 37 more effectively.

The other structure is the same as that of the first or second preferred embodiment.

Figure 9:
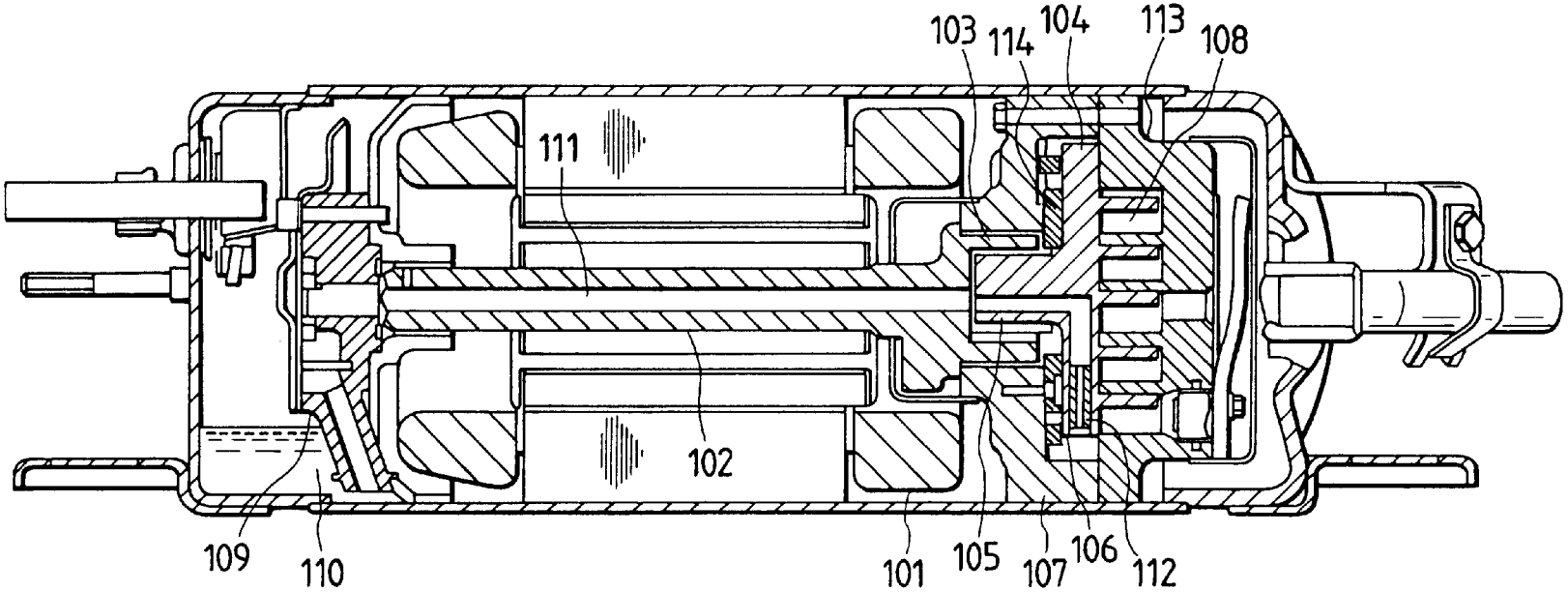
FIG. 9 PRIOR ART
FIG. 9 is a longitudinal sectional view of a conventional scroll compressor.

As appreciated, the Oldham's ring 15 of each of the third to sixth preferred embodiments can also be incorporated in the conventional scroll compressor shown in FIG. 9.

While the present invention has been described in terms of the preferred embodiments, the invention is not to be limited thereto, but can be embodied in various ways without departing from the principle of the invention as defined in the appended claims.

What is claimed is:

1. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

a rotation preventing member provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said rotation preventing member, wherein said inner region communicates with said outer region via an oil-feed passage formed through said orbiting scroll, wherein said oil-feed passage includes therein a restrictor and opens in the neighborhood of a first sliding portion between said rotation preventing member and said support member in said outer region so that lubricating oil supplied to said inner region is fed to the neighborhood of said first sliding portion via said oil-feed passage for lubrication of said first sliding portion;

wherein said compressor is a horizontal compressor;

wherein said oil-feed passage is open at a front side of said first sliding portion relative to an orbiting direction of said orbiting scroll; and wherein oil is fed through said oil-feed passage in response to a reaction force exerted on said rotation preventing means during compression of the compressor.

2. The scroll compressor according to claim 1, wherein said lubricating oil fed to the neighborhood of said first sliding portion moves downward under the influence of gravity to achieve lubrication of a second lower sliding portion between said rotation preventing member and said support member.

3. The scroll compressor according to claim 1, wherein said shaft portion is formed with an axial hole open to said inner region and extending in an axial direction of said crankshaft, said base plate is formed with a radial hole including said restrictor, said radial hole being continuous with said axial hole and extending radially upward relative to said crankshaft so as to open in the neighborhood of said first sliding portion, said axial and radial holes forming said oil-feed passage.

4. The scroll compressor according to claim 1, wherein an HFC refrigerant is used as said fluid and an ester oil is used as said lubricating oil.

5. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

a rotation preventing member provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said rotation preventing member, wherein said inner region communicates with said outer region via an oil-feed passage formed through said orbiting scroll, and wherein said oil-feed passage includes therein a restrictor and opens in the neighborhood of a first sliding portion between said rotation preventing member and said support member in said outer region so that lubricating oil supplied to said inner region is fed to the neighborhood of said first sliding portion via said oil-feed passage for lubrication of said first sliding portion, and wherein said rotation preventing member is an Oldham's ring provided with a key portion having a tapered end in a radially outward direction with respect to said Oldham's ring, said key portion engaging with said support member at said first sliding portion.

6. The scroll compressor according to claim 5, wherein an HFC refrigerant is used as said fluid and an ester oil is used as said lubricating oil.

7. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

a rotation preventing member provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said rotation preventing member, wherein said inner region communicates with said outer region via an oil-feed passage formed through said orbiting scroll, and wherein said oil-feed passage includes therein a restrictor and opens in the neighborhood of a first sliding portion between said rotation preventing member and said support member in said outer region so that lubricating oil supplied to said inner region is fed to the neighborhood of said first sliding portion via said oil-feed passage for lubrication of said first sliding portion, and wherein said rotation preventing member is an Oldham's ring provided with a key portion having a groove which extends slantly inward from a radially outward end of said key portion, said key portion engaging with said support member at said first sliding portion.

8. The scroll compressor according to claim 7, wherein an HFC refrigerant is used as said fluid and an ester oil is used as said lubricating oil.

9. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

a rotation preventing member provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said rotation preventing member, wherein said inner region communicates with said outer region via an oil-feed passage formed through said orbiting scroll, wherein said oil-feed passage includes therein a restrictor and opens in the neighborhood of a first sliding portion between said rotation preventing member and said support member in said outer region so that lubricating oil supplied to said inner region is fed to the neighborhood of said first sliding portion via said oil-feed passage for lubrication of said first sliding portion; and wherein said rotation preventing member is an Oldham's ring provided with a key portion having a bent through hole which extends inward from a radially outward end of said key portion, said key portion engaging with said support member at said first sliding portion.

10. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

a rotation preventing member provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said rotation preventing member, wherein said inner region communicates with said outer region via an oil-feed passage formed through said orbiting scroll, and wherein said oil-feed passage includes therein a restrictor and opens in the neighborhood of a first sliding portion between said rotation preventing member and said support member in said outer region so that lubricating oil supplied to said inner region is fed to the neighborhood of said first sliding portion via said oil-feed passage for lubrication of said first sliding portion, and wherein said rotation preventing member is an Oldham's ring provided with a key portion having a cavity at said sliding portion for storing the lubricating oil therein, said key portion engaging with said support member at said first sliding portion.

11. The scroll compressor according to claim 10, wherein an HFC refrigerant is used as said fluid and an ester oil is used as said lubricating oil.

12. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

an Oldham's ring provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said Oldham's ring, wherein said inner region communicates with said outer region via an oil-feed formed through said orbiting scroll so that lubricating oil supplied to said inner region is fed to said outer region, and wherein said Oldham's ring has key portions each having means for effectively feeding the lubricating oil in said outer region to corresponding sliding portions between said key portions and said support member.

13. The scroll compressor according to claim 12, wherein said effective feeding means comprises a bent hole which extends inward from a radially outward end of said key portion toward said sliding portion.

14. The scroll compressor according to claim 12, wherein an HFC refrigerant is used as said fluid and an ester oil is used as said lubricating oil.

15. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

an Oldham's ring provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said Oldham's ring, wherein said inner region communicates with said outer region via an oil-feed formed through said orbiting scroll so that lubricating oil supplied to said inner region is fed to said outer region, and wherein said Oldham's ring has key portions each having means for effectively feeding the lubricating oil in said outer region to corresponding one of sliding portions between said key portions and said support member, and wherein said means comprises a tapered end of said key portion provided in a radially outward direction with respect to said Oldham's ring.

16. The scroll compressor according to claim 15, wherein an HFC refrigerant is used as said fluid and an ester oil is used as said lubricating oil.

17. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

an Oldham's ring provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said Oldham's ring, wherein said inner region communicates with said outer region via an oil-feed formed through said orbiting scroll so that lubricating oil supplied to said inner region is fed to said outer region, and wherein said Oldham's ring has key portions each having means for effectively feeding the lubricating oil in said outer region to corresponding one of sliding portions between said key portions and said support member, and wherein said means comprises a groove of said key portion which extends inwardly from a radially outward end said key portion toward said sliding portion.

18. The scroll compressor according to claim 17, wherein an HFC refrigerant is used as said fluid and an ester oil is used as said lubricating oil.

19. A scroll compressor comprising:

a sealed casing:

a fixed scroll provided in the sealed casing, said fixed scroll having a first spiral vane;

an orbiting scroll provided in the sealed casing, said orbiting scroll having a base plate provided with a second spiral vane which is mated with said first spiral vane to define therebetween a plurality of compression chambers, said orbiting scroll further having a shaft portion which extends from said base plate and which is operatively connected with a crankshaft which is rotatably supported by a support member fixed in the sealed casing;

an Oldham's ring provided between said base plate and said support member for preventing rotation of said orbiting scroll on its axis;

an electric motor for driving said crankshaft to cause an orbital motion of said orbiting scroll via said shaft portion, said orbital motion reducing volumes of said compression chambers for compressing fluid introduced via a suction port; and a seal member disposed between said base plate and said support member for defining an inner region and an outer region, said shaft portion of the orbiting scroll exposed to said inner region, while said outer region communicating with said suction port and including therein said Oldham's ring, wherein said inner region communicates with said outer region via an oil-feed formed through said orbiting scroll so that lubricating oil supplied to said inner region is fed to said outer region, and wherein said Oldham's ring has key portions each having means for effectively feeding the lubricating oil in said outer region to corresponding one of sliding portions between said key portions and said support member, and wherein said means comprises a cavity of said key portion provided at said sliding portion for storing the lubricating oil therein.

20. The scroll compressor according to claim 19, wherein an HFC refrigerant is used as said fluid and an ester oil is used as said lubricating oil.

* * * * *